United States Patent [19]

German

[11] Patent Number: 4,481,791

[45] Date of Patent: Nov. 13, 1984

[54] INSULATED BEER KEG COOLER

[75] Inventor: Gary L. German, Farmington, Minn.

[73] Assignee: Royal Keg Cooler Corporation, Elko, Minn.

[21] Appl. No.: 558,049

[22] Filed: Dec. 5, 1983

[51] Int. Cl.[3] ..... B67D 5/62; F25D 3/08

[52] U.S. Cl. ..... 62/400; 62/457

[58] Field of Search ..... 62/400, 457, 371, 372, 62/529, 530, 463, 464

[56] References Cited

U.S. PATENT DOCUMENTS

| | | | |
|---|---|---|---|
| 2,792,692 | 5/1957 | Bryan | 62/400 X |
| 2,917,906 | 12/1959 | Woolley | 62/400 X |
| 3,308,636 | 3/1967 | Schaaf | 62/457 X |
| 3,789,622 | 2/1974 | Yanes | 62/400 X |
| 4,071,160 | 1/1978 | Vick | 62/400 X |

*Primary Examiner*—Lloyd L. King

[57] ABSTRACT

An insulated cooler for beer kegs which is specifically constructed to enclose both half-barrel and quarter-barrel kegs by inverting the top cover. The cooler has insulated bottom, top and side walls and encloses the keg with ice surrounding the same and provides an access opening through which the pump and tap assembly extends. Suitable handles are provided for carrying the keg and ice pack unit.

3 Claims, 3 Drawing Figures

INSULATED BEER KEG COOLER

BACKGROUND OF THE INVENTION

In the past, beer kegs have merely been cooled in ice-containing tubs which permit the ice to melt rapidly and are relatively unsanitary and unsightly in a party atmosphere.

SUMMARY OF THE INVENTION

The cooler embodying this invention provides an insulated ice-conserving container designed to surround a beer keg and keep the beer cold for long periods of time with very little ice required.

The removable top can be inverted to more closely surround a smaller quarter barrel keg as shown in FIG. 3 and is also provided with a keyhole slot which permits the use of a center mounted pump and tap assembly as well as the offset assembly illustrated. The body of the cooler unit has sufficient insulating properties to preserve for long periods of time the ice packed around the keg, even in hot weather, and in addition, provides an attractive housing for the keg instead of the unsightly tub or open top container frequently used.

DETAILED DESCRIPTION OF THE PREFERRED EMBODIMENT

Figure 2:
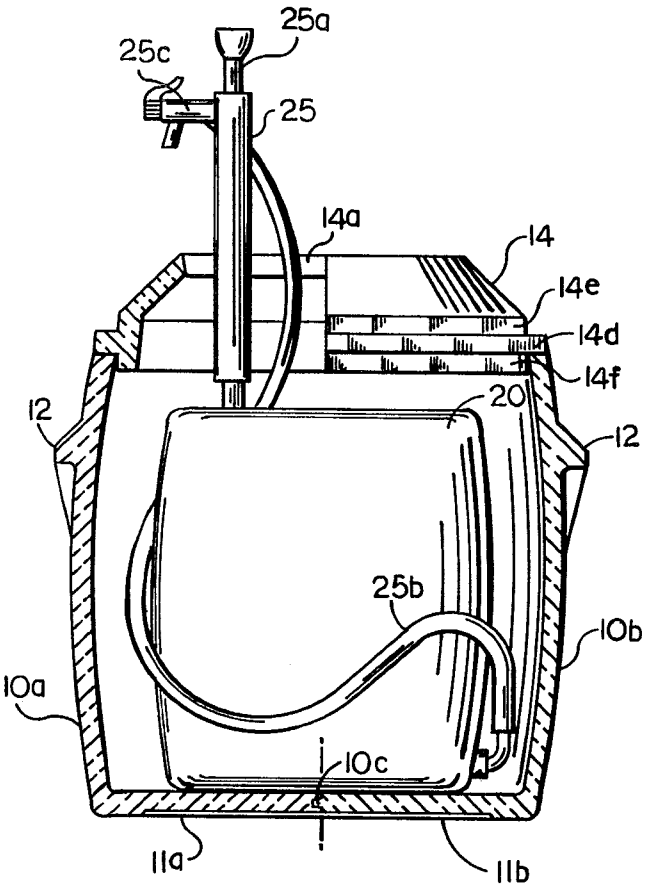
FIG. 2 is a sectional view of the cooler shown in FIG. 1 with portions shown in side elevation.

FIG. 2 shows a cooler made from a pair of sections having side wall portions 10*a* and 10*b*, respectively having bottom portions 11*a* and 11*b*, and handles 12. The sections are made from molded polyurethane foam. A suitable polyurethane material is manufactured by the Stepan Company of Chicago. Ill., and is produced by mixing in equal proportions, two separate ingredients identified by the Stepan Company as No. HW1160CR and No. HW1160A. In the form shown, the two sections have a mating tongue and groove edge joint 10*c* which is glued together by any suitable glue such as a hot-melt glue. A suitable glue is produced by the Dexter Corporation of Elsworth, Wis. and is identified as No. TW-ESP/1942. In the form shown, the male tongue element is formed on the edge of the side wall and bottom portions designated by the numerals 10*b* and 11*b* and the mating female groove portion is provided in the edge of the section identified as 10*a* and 11*a*.

Figure 3:
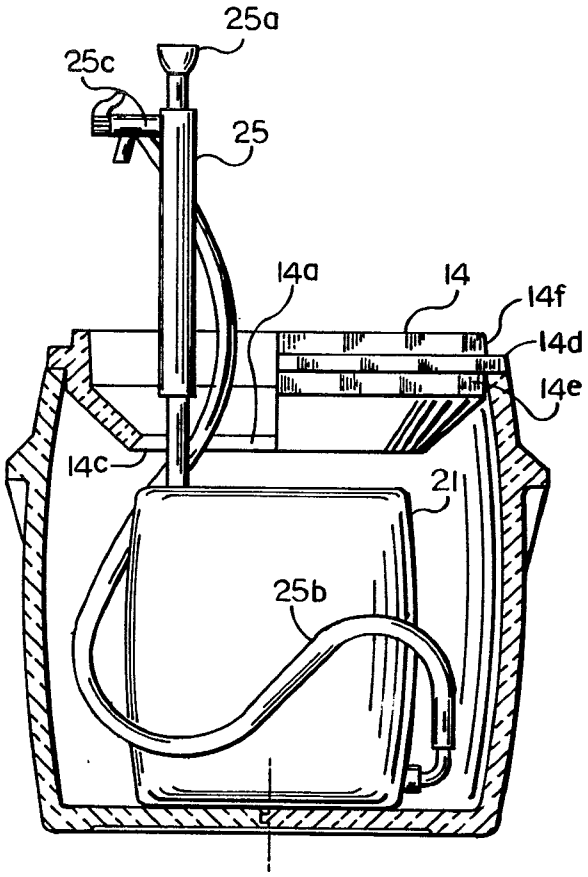
FIG. 3 is a view of the cooler with the cover inverted to more compactly enclose a smaller keg unit.
Figure 1:
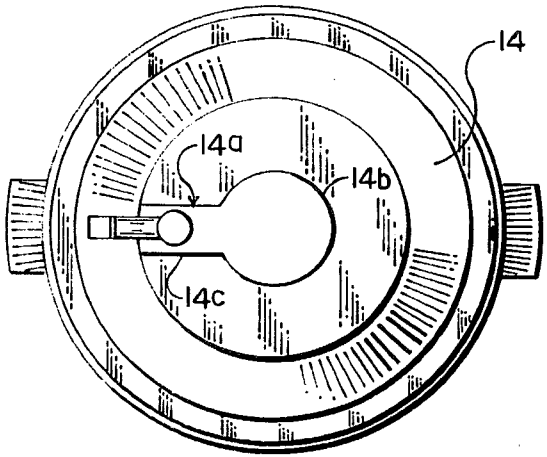
FIG. 1 is a top plan view of the cooler shown in FIG. 2.

A cover 14 is provided and is made from similar polyurethane foam material. The cover is generally concavo-convex in shape as illustrated and has a generally keyhole-shaped opening 14*a* formed in the top panel thereof. The opening has a circular central portion 14*b* and a radially extending slot portion 14*c* as best shown in FIG. 1. A support flange 14*d* is provided around the outer portion of the concavo-convex central section and is removably received around the top edge of the joined-together side wall sections 10*a* and 10*b*. A tight-fitting, slightly tapered circumferential wall portion 14*e* and 14*f* is provided on both sides of the flange 14*d* to be snugly received in frictional engagement within the top marginal edge portion of the side walls 10*a* and 10*b*. The connecting portion 14*f* is received in the cooler top when the larger size keg 20 is to be used, and the cover 14 is inverted when the smaller size keg 21 is to be used, with the connecting portion 14*e* tightly received within the top circumferential edge of the container body wall formed by the joined-together portions 10*a*, 10*b*, 11*a* and 11*b*, as best shown in FIG. 3.

The specific kegs 20 and 21 illustrated in the drawings show an off-center or edge-mounted pump and tap unit 25 of conventional design, which includes a pump element 25*a* and a flexible discharge tube 25*b* connected at the bottom of the respective kegs 20 and 21. A spigot and control valve assembly 25*c* of conventional design is provided to permit controlled dispensing of the contents of the kegs.

The cooler is designed of sufficient size to permit ice to be packed around the keg 20 and of course, the space between the smaller keg and the side walls of the container will be greater when being used for the smaller size keg 21.

It will be seen that this invention provides a highly efficient cooler for beer kegs which is particularly adapted for use with different sized kegs by merely inverting the concavo-convex cover unit. The keyhole opening 14*a* in the cover 14 provides for different locations for the various pump and tab assemblies including the eccentric mounting illustrated as well as a center mounted assembly (not shown).

It is to be understood that while there has been illustrated and described certain forms of the present invention, the invention is not to be limited to the specific form or arrangement of parts herein described and shown except to the extent that such limitations are found in the claims.

What is claimed is:

1. A cooler particularly constructed and designed for use with beer kegs, the cooler comprising rigid bottom and side wall portions all made from insulating material and defining an open-topped compartment therein of a size to leave at least a 2-inch space surrounding the side walls of a beer keg placed therein to permit a coolant to be confined around the keg within the cooler compartment, a removable cover having a flange therearound to be supported on the top of the cooler, a concavo-convex center cover portion disposed within said flange and extending upwardly when said cover is in one position, but extending downwardly into the compartment when said cover is inverted to substantially reduce the size of the keg-confining compartment within the cooler, said center cover portion having an opening therethrough to receive a pump and tap assembly fixed to the beer keg to permit dispensing of the beer from the keg confined within the cooler body.

2. The structure set forth in claim 1 wherein the opening in the cover has a keyhole shape with a generally circular central portion and a radially extending slot portion to permit a center mounted or an off-center mounted pump and tap assembly to be extended through the cover.

3. The structure set forth in claim 1 wherein the cover has a circumferential body portion on both sides of said flange to snugly engage the top portion of the side wall portions, regardless of the position of the cover placed thereon.

* * * * *